United States Patent [19]

Nishio et al.

[11] 4,414,483

[45] Nov. 8, 1983

[54] SPARK PLUG AND MANUFACTURING PROCESS THEREOF

[75] Inventors: Kanemitsu Nishio, Komaki; Shunichi Takagi, Tajimi; Yasuhiko Suzuki, Nagoya, all of Japan

[73] Assignee: NGK Spark Plug Co., Ltd., Nagoya, Japan

[21] Appl. No.: 185,955

[22] Filed: Sep. 10, 1980

[30] Foreign Application Priority Data

Sep. 14, 1979 [JP] Japan ..... 54-118047

[51] Int. Cl.[3] ..... H01T 13/20; F23Q 3/70

[52] U.S. Cl. ..... 313/136; 313/141; 445/7

[58] Field of Search ..... 313/141, 133, 142, 136; 29/25.12; 445/7

[56] References Cited

U.S. PATENT DOCUMENTS

| | | | |
|---|---|---|---|
| 2,265,352 | 12/1941 | Corbin et al. | 313/141 X |
| 2,296,045 | 9/1942 | McDougal et al. | 313/142 X |
| 2,505,150 | 4/1950 | Schwartzwalder et al. | 313/136 X |
| 3,349,275 | 10/1967 | Blum et al. | 313/124 X |
| 3,567,658 | 3/1971 | Webb et al. | 313/136 X |
| 4,001,145 | 1/1977 | Sakai et al. | 252/513 |
| 4,006,106 | 2/1977 | Yoshida et al. | 252/513 |

*Primary Examiner*—Palmer C. Demeo

*Attorney, Agent, or Firm*—Wegner & Bretschneider

[57] ABSTRACT

A spark plug with a rivet-like tip center discharge electrode is obtained by melting powdery metal essentially consisting of noble metal Au, Ag and/or alloys thereof with Pd or the like charged in a small end bore formed at a discharge end bottom of a ceramic insulator then allowing to cool. Sealing and/or resistor incorporation together with setting (sealing) of a terminal rod may be done one-stepwise with the center electrode formation or two-stepwise after the center electrode formation. A resultant space in the center bore may be utilized for various purposes.

30 Claims, 8 Drawing Figures

SPARK PLUG AND MANUFACTURING PROCESS THEREOF

BACKGROUND

The present invention relates to a spark plug having a novel center discharge electrode and a manufacturing process thereof.

In the prior art, conventional types of spark plugs have a metallic center discharge electrode (center electrode hereinafter) which is formed of a nickel rod with a copper core or a nickel rod to which a tip of Au-Pd alloy is welded. In the former type, a high dimensional accuracy for each parts, particularly that for an inner diameter of a discharge tip portion of a refractory insulator (insulator hereinafter) and for an outer diameter of the center electrode is required. Furthermore, a sealing process for these parts should be controlled in a highest accuracy in respect to sealing and impact resistance properties of such products. Those are marked as drawbacks of this type of the spark plug.

In the latter type, an improved durable life is obtained, whereas it requires an additional step of welding and a larger amount of discharge tip metal is consumed rather than actually necessary for discharge per se although merely a minor amount thereof functions as such in the practice. The discharge tip is usually welded to the head portion with an enlarged diameter of a base electrode rod formed in a rivet like (T type cross-section) form, which is necessary for preventing the discharge electrode from dropping off in order to mechanically form-lockingly secure it to a discharge end bore of the insulator, because a detriment to bonding strength of welded portion during an application under a high temperature would otherwise be caused. Those facts make this type also accompanied with a higher cost of manufacture.

SUMMARY OF THE INVENTION

Accordingly, it is an object of the present invention to provide a novel spark plug which can eliminate the drawbacks in the prior art as hereinabove mentioned.

It is another object of the present invention to provide a novel manufacturing process for the spark plug which can be carried out with ease.

It is a further object of the present invention to provide a spark plug having a tip type center discharge electrode capable of eliminating a further step to be welded.

It is a still further object of the present invention to provide a spark plug having an inproved self-cleaning properties of the discharge end portion.

Further objects of the invention will become apparent in the following description of the invention.

The present invention provides a spark plug which comprises a refractory insulator with a center bore having a bottom end provided with a small end bore and a center discharge electrode therein which has a discharge end of semispherical or semispheroidal surface and is formed by melting powdery metal charged in said small end bore and/or in the bottom end of said center bore.

The present invention also provides a process for manufacturing said type of spark plug which includes following steps:

forming a small end bore at a bottom end of the refractory insulator with a center bore, charging the bottom end of the center bore and/or the small end bore with powdery metal, and heating the powdery metal to melt so as to form a center discharge electrode thereat due to the surface tension of the molten metal and the gravitation thereto.

The present invention further provides a manufacturing process of the spark plug of a type as aforementioned which comprises steps in a sequence as follows:

forming a small end bore at a bottom end of the refractory insulator with a center bore, charging the bottom end of the center bore and/or the small end bore with powdery metal, charging the center bore with a sealing-filling material, inserting a terminal rod in the center bore, heating the resultant assembly to soften the sealing-filling material and simultaneously melting the powdery metal, and hot-pressing the charged mass to form a center electrode simultaneously with to seal the sealing-filling material.

The present invention is further described and illustrated with reference to drawings which illustrate preferred embodiments of the invention.

BRIEF DESCRIPTION OF THE DRAWINGS

The present invention is illustrated in drawings for better illustration and understanding thereof and not for limitation thereof, a modification may be made without departing from the spirit and scope of the present invention.

In the drawings shows each Figure as follows.

DETAILED DESCRIPTION OF THE INVENTION

Figure 1:
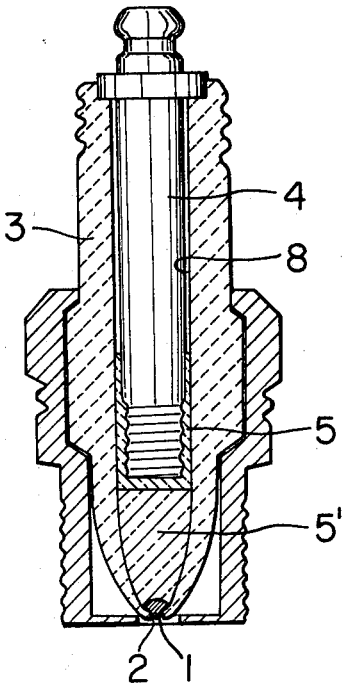
FIG. 1 and FIG. 3 show an embodiment of the invention in a longitudinal section thereof, respectively.
Figure 3:
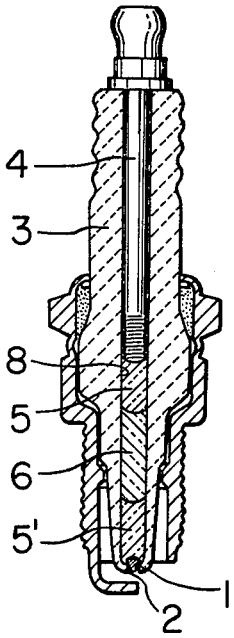
Figure 2:
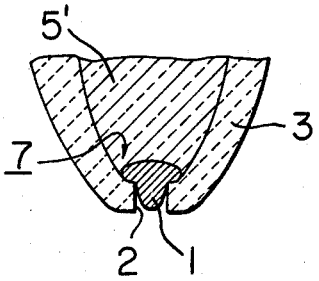
FIG. 2 and FIG. 4 show an enlarged discharge center electrode portion of FIG. 1 and FIG. 3, respectively.
Figure 4:
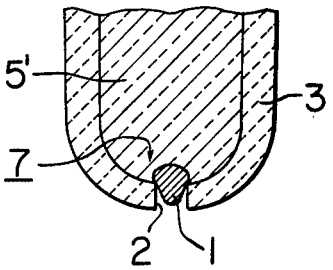
Figure 5:
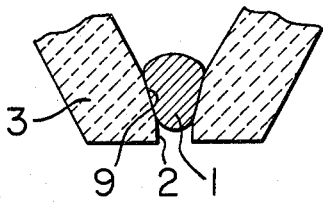
FIG. 5–FIG. 8 show a further embodiment of the invention in a partial sectional view, respectively.
Figure 6:
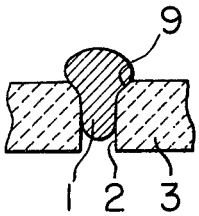
Figure 7:
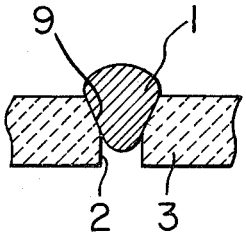
Figure 8:
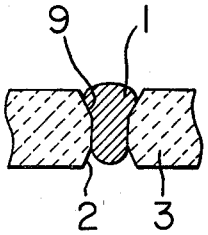

In FIG. 1, a refaractory insulator 3 is usually made of high alumina ceramic insulator with a center bore 8 having an open end at the top (in FIG. 1) and a closed end at the bottom which bottom end is provided with a small end bore 2 communicating the center bore bottom to the outer space. The small end bore (end bore hereinafter) 2 is an end bore for receiving and forming a center discharge electrode therein or also in the vicinity thereof which is usually of a circular cylindrical bore form or the like having a diametric dimension of approximately 0.5–2.5 mm. The end bore may be beveled or tapered at either of one end thereof, and may be tapered inwardly towards the center bore bottom and/or outwards to the discharge formation outer space, a further modification of the end bore shape may be allowed optionally or additionally thereto. Tapered portion 9 shown in FIGS. 5–8 can be partly and/or over a whole length formed in the end bore region and/or end portion thereof. Particularly preferred is the tapering or beveling having an increasing diameter towards the center bore which will produce an improved adaptability in respect to the deformation or formation of the center electrode which is formed by melting, and an improved adhesive sealability with an enlarged contact area, and will prevent the center electrode from dropping off from the end bore. The tapering or beveling with an increasing diameter towards the discharge outer space may dimentionally be defined under the consideration of a discharge surface form of the center electrode and location in the bore (depth of a resultant recess), selfcleaning effect and further factors which may affect on, with respect to a spark way on discharge.

The bottom portion of the center bore 8 can gradually be tapered towards the bottom end thereof with its decreasing diameter, and it is preferred to form such a tapered portion in the region of at least up to a point a little above the small end bore particularly for charging powdery metal and other resultant properties.

The form of the center electrode, particularly of the bottom end i.e. discharge end is semispherical or semispheroidal formed mainly due to the balance of the surface tension and viscosity of the molten metal and the gravity thereto. The form of the center electrode as a whole is defined depending upon different factors such as forms of the end bore 2 and the center bore 8 bottom, values of viscosity and surface tension of the molten metal, wettability (i.e. contact angle) of the molten metal against inner surfaces of the end bore 2 and the center bore 8 bottom, also a pressure incurred by the upper layer of sealing-filling material upon hot-pressing which will be described hereinafter.

The form of the upper head portion of the center electrode 2 is usually $\frac{3}{4}$-spherical or -spheroidal, however, it allows alterations or modifications therefrom depending upon the forms of an internal end of the end bore 2 and the bottom of the center bore 8, and a pressure incurred when the sealing-filling material is forcedly or pressedly sealed.

For an end bore having cylindrical bore-like form, an approximately rivet-like tip center electrode can be formed which has a flat spheroidal head and discharge end portion extending from the lower end of the head outwardly (i.e. downwardly in Figures) in the end bore and being adapted to be secured therein with respect to its form. The discharge end of the center electrode is usually located in the end bore or retracted from the outer insulator bottom end, and it is preferred, however, a protruding formation or location of the discharge end from the center bore end or the outer insulator bottom end. This location of the discharge end is defined with a relationship to factors such as the form of the end bore and the form of the surrounding insulator end portion under consideration of selfcleaning properties of the spark plug.

In the following, a process of the spark plug in the present invention is further disclosed in detail.

According to a first embodiment of the invention (2-stepwise process), a small amount of powdery metal is charged in the bottom end of the center bore 8 and/or in the end bore 2, usually precompacted, then heated to melt. The molten melt will retain an approximately spherical form due to the surface tension thereof, however, as the end bore 2 opens at the bottom of the central bore 8, it flows and hangs down in the end bore in a balance state between the gravity and the surface tension. The metal is allowed to cool in this state, whereon an approximately rivet-like center electrode is produced sealingly secured to the internal tip end of the end bore 2. Thereafter, a desired sealing-filling material is charged in the center bore 8, resultant charged mass is precompacted or prepressed, if necessary, then a terminal rod 4 is forcively inserted thereon in the center bore 8, finally, the charged mass is heated to be sealed under a temperature usually of not exceeding the melting point of the center electrode metal, but above the softening temperature of the sealing-filling material whereby a spark plug center body is manufactured. For this sealing and terminal rod-setting procedure, a conventional one may be applied with appropriate modifications. A sealing temperature of the sealing-filling material higher than the melting point of the electrode metal is not necessarily excluded, however, in such a case, a controlled application of the pressing force upon the mass should be taken in account. The terminal rod is, as is conventionally done, preferablly simultaneously pressed onto the charged mass so that this procedure allows a simultaneous setting and sealing of the terminal rod in a fixed position in the center bore and electrically connected to the center electrode.

If the powdery metal is charged only in the end bore 2, a center electrode is formed which has a corresponding modified form to that of the end bore 2.

The powder metal for the center electrode 1 essentially consists of one selected from the group consisting of Au, Ag, Au-Ag alloy, alloys of each foregoing metal with Pd, Ni, Cr or Ni-Cr, alloys of each of Au-Pd, Ag-Pd, Au-Ag-Pd with Ni, Cr or Ni-Cr, and Ag-Pt alloy. Preferred are following alloys; Ag-Au, Ag-Pd, Ag-At-Pd, Ag-Cr, Ag-Au-Cr, Ag-Pd-Cr, Au-Pd, Au-Cr, Au-Pd-Cr and Ag-Pt. The melting point of the powdery metal ranges 900°–1200° C., preferably 950°–1100° C. which can withstand the high temperature on spark discharges in the engine cylinder. Such powder metal encompasses, e.g. noble metal Ag, Au, a Ag-Au alloy consisting of 40–80% of Ag and a balance of Au by weight (as hereinafter if not otherwise mentioned), an alloy further comprising 1–10% Pd and/or 1–3% Cr additionally to said Ag-Au alloy components, an Ag-Pd alloy consisting of 70–95% Ag and the balance of Pd, and an alloy which further contains 1–3% Cr thereto, a Ag-Pt alloy of 85–95% Ag and the balance of Pt, a Au-Pd alloy of 80–95% Au and a balance of Pd, and an alloy further containing 1–3% Cr thereto. The grain size of the powdery metal is preferably through 100 mesh. Before entering further steps, the powder metal charged in the end bore 2 is advantageously compacted by applying a punch upwardly on the bottom of the end bore and a pertinent rod downwardly on the top, which prevents the compacted powdery metal from collapsing down from the end bore on vibrations or shocks.

The sealing temperature of the sealing-filling material as hereinmentioned should be lower than the melting point of the powder metal. The term "sealing-filling material" in the present invention includes at least one conductive sealing composition 5, 5' (powder material preferably with organic binder) including a metal conductive component, a borosilicate glass frit and further optional filling materials such as resistor material 6, auxiliary agent, e.g. electro-stabilizer for the resistor material and the like.

The lower end of the center electrode 1 is usually formed retracted in the end bore 2 due to shrinkage of the molten metal upon cooling, however, the location of the discharge end of the center electrode may be modified if desired depending upon metal compositions, charged amount of the powdery metal, heating temperature of the metal and diametric dimensions of the end bore and so on.

The charging of the bottom portion of the center bore 8 with the powdery metal may be carried out preferably by applying a pressure by way of inserting a rod from the top opening while a suitable punch is employed thereon at the end bore bottom.

A second procedure of manufacturing the spark plug of the invention allows a simultaneous sealing of the sealing-filling material at the same time with melting-/forming procedure of the center electrode 1. The powdery material is first filled in the center bore bottom, a conductive sealing glass powder, if desired further optional resistor material powder (the latter two being termed as "sealing-filling material") is/are filled in and rammed or compacted, then a terminal rod is inserted thereon in the center bore 8, thereafter the assembly is heated under pressure application upon the terminal rod head to melt the powdery metal and simultaneously to soften the sealing-filling material, whereupon the center electrode 1 is formed and sealingly adhered to the inner walls and/or the inner end of the end bore 2 then the assembly is allowed to cool. Upon cooling, a spark plug center body assembly is obtained. The sealing-filling material used in this procedure is at least sealable within the temperature range approximately equal to the melting point of the powdery metal in order to melt the powdery metal simultaneously with sealing of the sealing-filling material by a hot-pressing after the insertion of the terminal rod 4. For this purpose, the sealing-filling material comprises a sealing material, e.g. a conductive sealing glass powder, which has a softening temperature of not exceeding the melting point of the powdery metal.

The powder metal which is desclosed hereinbefore in the first procedure (2 step-procedure) is also employed in this procedure(simultaneous procedure).

The sealing-filling material in the present invention comprises at least one conductive sealing material and optionally resistor material or other desired filling material. The conductive sealing material is at least sealable at the melting temperature range of the powdery metal employed, wherein one having a softening temperature of not exceeding the melting point of the powdery metal will satisfy the requirement. The conductive sealing glass composition encompasses a conductive sealing glass composition which comprises 30–70% metallic ingredients and the balance of borosilicate glass frit, the metallic ingredients essentially consisting of one or more selected from the group consisting of Cu, Ni, Fe, Fe-B alloy, Ni-B alloy, Cr, Ag, Co, Mo, W, Fe-Ti alloy, and alloys thereof.

For this purpose, a borosilicate glass frit having following composition by weight percent is employed subject to that the softening point thereof is not exceeding the melting point of the powdery metal employed:

40–80% $SiO_2$, 5–50% $B_2O_3$, 0–23% $Al_2O_3$, 0–10% PbO, 0–10% in total of $Na_2O$, $K_2O$ and/or $Li_2O$, and 0–15% in total of BaO, CaO and/or MgO, preferably, a composition of:

40–70% $SiO_2$, 15–45% $B_2O_3$, 3–20% $Al_2O_3$, 0–8% PbO, 0–8% in total of $Na_2O$, $K_2O$ and/or $Li_2O$, and 0–11% in total of BaO, CaO and/or MgO.

Most preferably, a borosilicate glass frit consisting of 40–70% $SiO_2$, 15–45% $B_2O_3$ and 3–10% $Al_2O_3$ is employed. The softening temperature of such borosilicate glass frit should be not less than approximately 600° C. as the discharge end of the spark plug is usually subjected to a high temperature of 800°–900° C., and an appropriate borosilicate glass having a softening temperature which can withstand the temperature on use should be selected according to a duty. For sealing the vicinity of the center electrode, it is preferred to use a borosilicate glass frit having a softening temperature of not less than 700° C. whereas for the middle portion of the center bore may be the softening temperature thereof not less than 600° C.

Some preferred frits are listed in Table 1. These firts are not limitative and other borosilicate glasses falling within the scope as above mentioned may be employed.

TABLE 1

| | Ingredients | | | | | | | | | |
|---|---|---|---|---|---|---|---|---|---|---|
| Glass | $SiO_2$ | $B_2O_3$ | $Al_2O_3$ | PbO | $Na_2O$ | $K_2O$ | $Li_2O$ | BaO | CaO | MgO |
| A | 55 | 30 | 5 | 5 | 5 | — | — | — | — | — |
| B | 65 | 25 | 6 | — | — | 4 | — | — | — | — |
| C | 65 | 23 | 5 | — | 7 | — | — | — | — | — |
| D | 65 | 30 | 5 | — | — | — | — | — | — | — |
| E | 63.1 | 27.8 | 2.5 | — | 6.8 | — | — | — | — | — |
| F | 56.0 | 33.5 | 0.8 | — | 4.4 | — | 1.7 | — | 3.4 | — |
| G | 57.1 | 21.1 | 10.3 | 0.1 | 0.16 | 0.48 | — | 3.6 | 6.9 | — |
| H* | 60.1 | 7.1 | 18.5 | — | 0.6 | 0.5 | — | — | 6.3 | 6.9 |

*(softening temp. 900° C.)

The resistor material which may optionally be used in the present invention encompasses those which are sealable during the sealing/melting procedure of the sealing material/powdery metal by way of hot-pressing. As such a resistor material, a powdery mixture may be applied which, e.g., essentially consists of a 30–70 parts by weight of borosilicate glass frit as aforementioned, 20–40 parts by weight of an aggregate consisting of alumina, zircon, zirconia, mullite and clay, 10–30 parts by weight of nitride such as $Si_3N_4$, AlN, BN or the like, and 0.5–4 parts by weight of a carbonaceous material, preferably methyl cellulose. The carbonaceous material encompasses cellulose derivatives such as methyl cellulose or carboxyl methyl cellulose, polyhydric alcohol such as glycerin or sorbitol, sacchrides such as sugar, polyvinyl alcohol, arabic gum or the like which will produce resultant carbon or carbon containing substances upon heating.

The center electrode as produced according to the second procedure of the invention usually forms a discharge end which retracts from the outer insulator bottom end in the end bore 2 due to the shrinkage of the metal on cooling, whereby an electrical self-cleaning property can be attained as well as by way of the first two-stepwise procedure.

In either case of the first and second procedure, it is preferred exactly to control a charge amount of the powdery metal. In the latter second procedure, a practical dimensional accuracy of the center electrode may be achieved by way of controlling the heating temperature, applying pressure upon sealing, which renders an advantage to the present invention.

In this respect, suppose that a procedure employing also molten metal, e.g. casting procedure for center electrode manufacture (casting molten metal in the center bore) is applied, a precise control of the cast or poured molten metal therein is difficult, which makes an advantage of the invention apparent.

In the second one-stepwise procedure, the end bore 2 may have a diameter of approximately 0.8–2.5 mm, preferably it is 1–2 mm. The center bore 8 may be formed such that with a varying diameter stepwisely and/or gradually. As the discharge center electrode of the present invention is formed of only a tip-like electrode metal piece, the end bore is preferably tapered which enables to reduce a noble metal consumption of Au, Ag, Pd, Pt and the like. Furthermore, it is advantageous in the present invention that the space which would conventionally be occupied by the conventional center electrode rod may be eliminated or utilized for other objects. Some ways of the utilization of such space may be contemplated as follows: an enlarged resistor space and a closer location thereof to the discharging area in a resistor incorporated spark plug which can improve in reducing an interference to the radio wave caused by a spark discharge, a reduction of thermal capacity of the discharge end (bottom) portion of the spark plug improving a thermal balance thereof, a formation of a conductive sealing glass layer for a better sealing, and so on.

According to the second (one-stepwise) procedure, the center electrode formation and the sealing of the sealing-filling material can simultaneously be accomplished in a single procedure, which fascilitates a mass production thereof, and enables some elimination of the steps in the spark plug manufacture and a reduction in cost. Furthermore, the spark plug of the invention provides an improved self-cleaning property due to the arrangement of the selected end bore with its suitably specified end form coupled with a retracted discharge end of the center electrode as may be produced with ease. A better igniting property may also be obtained due to the spherical surface form of the discharge end of the center electrode.

In the following, preferred embodiments of the present invention are described for better illustration.

EXAMPLE 1 (2-stepwise procedure)

A high alumina ceramic insulator having a center bore 8 of 3.6 mm diameter and 65 mm length, the bottom end thereof being tapered to form a closed end which has a through small end bore with 1.5 mm diameter and 1.2 mm depth was firstly prepared. The bottom space of the center bore and the end bore are charged with 0.1 g of an powdery alloy through 100 mesh consisting of 90% by weight of Ag and the balance of Pd, the end bore was upwardly punched by a punch on its lower (outer) end, and a compacting rod was inserted downwardly in the center bore thus pressing the powdery alloy to be compacted. The rod was removed after the compaction, then the assembly was heated at a temperature range up to 1000°–1050° C. for 10 minutes, thereafter allowed to cool resulting in a center electrode having a spherical discharge end. 0.2 g of a conductive sealing glass composition (powder) consisting of 60% by weight of Cu and the balance of a borosilicate glass frit (65% $SiO_2$, 30% $B_2O_3$ and 5% $Al_2O_3$ by weight) was charged with in the center bore bottom, then 0.4 g of a resistor material composition (powder) consisting of 40 parts borosilicate glass frit as identified above, 30 parts zircon, 30 parts $Si_3N_4$ and 2 parts methyl cellulose by weight, respectively, was superposedly filled thereon in the center bore. Then 0.3 g of the conductive sealing glass composition was filled therein. Each charged mass was precompacted after each charging, respectively. A terminal rod made of nickel-plated low carbon steel with 3.4 mm diameter and 40 mm length was forcively inserted in the center boer 8, then the assembly was subjected to heat up to 800°–1000° C. during 10 minutes simultaneously under a pressure application of approximately 15 kg/cm$^2$, whereby the terminal rod in the center bore was sealed with the charged mass. The assembly was allowed to cool resulting in a spark plug center body assembly with a rivet-like center electrode and the terminal rod.

EXAMPLE 2 (one-stepwise procedure)

0.1 g of powdery metal through 100 mesh consisting of 75% Au and 25% Ag by weight was first filled in the bottom portion 7 of the center bore 8 formed in the same ceramic insulator as employed in Example 1, then the conductive sealing glass composition, the carbonaceous resistor material, the conductive sealing glass composition which are the same and of the same amounts as in Example 1, respectively, were superposedly charged in the center bore, each charged mass having been precompacted after each charging, respectively. The same terminal rod was then inserted as in Example 1. The resultant assembly was heated upto 1000°–1050° C. in a continuously operating furnace for 10 minutes then the terminal rod 4 was forcively pressed down under a pressure application of 20–50 kg/cm$^2$ during a hot state (hot-pressed). After cooling, a spark plug center body assembly with a revet-like center electrode 1 was obtained.

As the sealing-filling material which may be used in the present invention, a semiconductive resistance material and/or a carbonaceous resistance material which are disclosed in U.S. Pat. No. 4,144,474 K. Nishio et al, a selfsealable glassy resistor composition disclosed in U.S. Pat. No. 4,006,106 M. Yoshida et al, or a resistor composition disclosed in U.S. Pat. No. 4,173,731 S. Takagi et al can be used in the present invention subject to the requirement of the invention and appropriate modifications, if necessary. The descriptions of such materials are incorporated in the present invention by reference to the U.S. patents hereinabove identified.

We claim:

1. A spark plug, comprising:

a refractory insulator with a center bore having a bottom end provided with a small end bore having a smaller diameter than the center bore; and a center discharge electrode therein which has a discharge end of semispherical or semispheroidal surface and is formed by melting metallic powder charged in said small end bore and/or in the bottom end of said center bore.

2. A spark plug defined in claim 1, wherein the metallic powder essentially consists of one selected from the group consisting of Au, Ag, Au-Ag alloy, alloys of each foregoing metal with Pd, Ni, Cr or Ni-Cr, alloys of each of Au-Pd, Ag-Pd and Au-Ag-Pd with Ni, Cr or Ni-Cr, and Ag-Pt alloy.

3. A spark plug defined in claim 1 or 2, wherein said metallic powder has a melting point ranging 900°–1200° C.

4. A spark plug defined in claim 1, wherein said small end bore has a tapered portion with an increasing diameter towards the inside of said center bore and/or in a reverse direction.

5. A spark plug defined in claim 1 or 4, wherein said small end bore is a cylindrical bore optionally with a beveling at an inner and/or outer end thereof.

6. A spark plug defined in claim 1, wherein said discharge end of the center discharge electrode is formed within said small end bore.

7. A spark plug defined in claim 1, wherein said discharge end of the center discharge electrode is formed flush with or outwardly protruding beyond the refractory insulator end.

8. A process for manufacturing a spark plug comprising:

forming a small end bore at a bottom end of a refractory insulator with a center bore, said small end bore having a smaller diameter than said center bore, charging the bottom end of the center bore and/or the small end bore with metallic powder, and heating the metallic powder to its melting point so as to form a center discharge electrode thereat due to the surface tension of the molten metal and the effect of gravitation thereon.

9. A process defined in claim 8, wherein said small end bore is tapered and/or beveled at either or one end thereof.

10. A process defined in claim 8 or 9, wherein said small end bore is a cylindrical bore or the like.

11. A process defined in claim 8, wherein the metallic powder has a melting point ranging 900°–1200° C.

12. A process defined in claim 8 or 11, wherein the metallic powder essentially consists of one selected from the group consisting of Au, Ag, Au-Ag alloy, alloys of each foregoing metal with Pd, Ni, Cr or Ni-Cr, alloys of each of Au-Pd, Ag-Pd and Au-Ag-Pd with Ni, Cr or Ni-Cr, and Ag-Pt alloy.

13. A process for manufacturing a spark plug which comprises steps in a sequence as follows:

forming a small end bore at a bottom end of a refractory insulator with a center bore, said small end bore having a smaller diameter than said center bore, charging the bottom end of the center bore and/or the small end bore with metallic powder, charging the center bore with a sealing-filling material, inserting a terminal rod in the center bore, heating the resultant assembly to soften the sealing-filling material and simultaneously melting the metallic powder, and hot-pressing the charged mass to form a center electrode simultaneously with the sealing of the sealing-filling material.

14. A process defined in claim 13, wherein the metallic powder has a melting point of 900°–1200° C.

15. A process defined in claim 13 or 14, wherein the metallic powder essentially consists of one selected from a group consisting of Au, Ag, Au-Ag alloy, alloys of each foregoing metal with Pd, Ni, Cr or Ni-Cr, alloys of each of Au-Pd, Ag-Pd and Au-Ag-Pd with Ni, Cr or Ni-Cr, and Ag-Pt alloy.

16. A process defined in claim 13, wherein the sealing-filling material comprises at least one sealing powder material and optionally powdery resistor material and/or other desired filling materials in a mixture state and/or in a superposed state.

17. A process defined in claim 16, wherein the sealing powder material is sealable at least at the melting temperature range of the metallic powder.

18. A process defined in claim 16 or 17, wherein the sealing powder material has a softening temperature of not exceeding the melting temperature of the metallic powder for the center discharge electrode.

19. A process defined in claim 13, wherein the small end bore is tapered or beveled at either one end or both ends thereof.

20. A process defined in claim 13 or 19, wherein the small end bore is a cylindrical bore or the like.

21. A process defined in claim 16, wherein the sealing filling material consists essentially of 30–70% metallic ingredients and the balance of borosilicate glass frit and the metallic ingredients consist essentially of one or more selected from the group consisting of Cu, Ni, Fe, Fe-B alloys, Ni-B alloys, Cr, Ag, Co, Mo, W, Fe-Ti alloys and alloys thereof.

22. A process defined in claim 21, wherein the borosilicate glass frit has a softening point not exceeding the melting point of the metallic powder and having the following composition by weight:

40–80% $SiO_2$, 5–50% $B_2O_3$, 0–23% $Al_2O_3$, 0–10% PbO, 0–10% in total of $Na_2O$, $K_2O$ and/or $Li_2O$, and 0–15% in total of BaO, CaO and/or MgO.

23. A process defined in claim 21, wherein the borosilicate glass frit is essentially consisting of 40–70% $SiO_2$, 15–45% $B_2O_3$ and 3–10% $Al_2O_3$ by weight.

24. A process defined in claim 16, wherein the powdery resistor material essentially consists of 30–70 parts of a borosilicate glass frit, 20–40 parts of an aggregate essentially consisting of alumina, zircon, zirconia, mullite and clay, 10–30 parts of nitride which is $Si_3N_4$, AlN, BN or a mixture thereof, and 0.5–4 parts of carbonaceous material by weight, respectively.

25. A process defined in claim 24, wherein the borosilicate glass frit is the frit as defined in claim 22.

26. A spark plug which is obtained by the process defined in claim 8 or 11.

27. A spark plug which is obtained by the process defined in claim 12.

28. A spark plug which is obtained by the process defined in any one of claims 13, 14, 16, 17, 19 or 21–25.

29. A spark plug which is obtained by the process defined in claim 15.

30. A spark plug which is obtained by the process defined in claim 18.

* * * * *